US005540856A

United States Patent [19]

Wevers et al.

[11] Patent Number: 5,540,856

[45] Date of Patent: Jul. 30, 1996

[54] FOAM CONTROL AGENTS IN GRANULAR FORM

[75] Inventors: Jean Wevers, Strombeek-Bever; Marcel J. J. De Cupere, Kessel-Lo, both of Belgium

[73] Assignee: The Procter & Gamble Company, Cincinnati, Ohio

[21] Appl. No.: 483,598

[22] Filed: Jun. 7, 1995

Related U.S. Application Data

[63] Continuation of Ser. No. 162,003, filed as PCT/US92/04460, May 22, 1992, abandoned.

[51] Int. Cl.[6] ..... C11D 17/00

[52] U.S. Cl. ..... 510/347; 252/321

[58] Field of Search ..... 252/90, 174.15, 252/174.17, 174.23, 174.13, 174

[56] References Cited

U.S. PATENT DOCUMENTS

| | | | |
|---|---|---|---|
| 4,447,349 | 5/1984 | Tai | 252/174.13 |
| 4,451,387 | 5/1984 | Tai | 252/174.15 |
| 4,652,392 | 3/1987 | Baginski et al. | 252/109 |
| 4,806,266 | 2/1989 | Burrill | 252/174.15 |
| 4,824,593 | 4/1989 | Appel et al. | 252/127 |
| 5,238,596 | 8/1993 | Smith | 252/174.15 |

FOREIGN PATENT DOCUMENTS

| | | | |
|---|---|---|---|
| 0142910 | 5/1985 | European Pat. Off. | C11D 3/00 |
| 0206522 | 12/1986 | European Pat. Off. | C11D 3/00 |
| 210731 | 2/1987 | European Pat. Off. | C11D 3/37 |

*Primary Examiner*—Asok Pal
*Assistant Examiner*—Patricia L. Hailey
*Attorney, Agent, or Firm*—Ken K. Patel; Jacobus C. Rasser; Jerry J. Yetter

[57] ABSTRACT

The present invention provides stable, free-flowing foam-control agent in granular form, comprising a silicone anti-foam compound, a carrier material, an organic coating material, characterized in, that they contain a crystalline or amorphous aluminosilicate, at a weight ratio with the silicone antifoam compound of 1/5 to 2/1.

The present invention also provides a method to make such agents, and detergent compositions containing said foam control agent.

11 Claims, No Drawings

FOAM CONTROL AGENTS IN GRANULAR FORM

This a continuation of application Ser. No, 08/162,003, filed as PCT/US92/04460, May 22, 1992.

TECHNICAL FIELD

The present invention is concerned with foam control agents in granular form, with a method for making such agents, and with detergent compositions containing such agents.

BACKGROUND

It has become common practice in the detergent industry to include in detergent compositions materials which are intended to control the amount of foam produced during a washing cycle in a washing machine.

Indeed, excessive sudsing has been found to interfere negatively with the action of the wash liquor upon the fabrics.

Silicone antifoam agents have been found to be particularly effective species, and efforts have been directed to increase the stability of such agents upon prolonged storage of the detergent compositions containing them.

In GB 1,492,339, it has been proposed to coat silicone antifoam agents with an organic material which is a water soluble or water dispersible, substantially non-surface active, detergent-impermeable material e.g. gelatin, agar or certain reaction products of tallow alcohol and ethylene oxide.

In EP-A-210 721, it has been proposed to coat silicone antifoam agents with water-insoluble fatty acid or fatty alcohols, and in EP-A-210 731 it has been disclosed to coat silicone antifoam agents with a monoester of glycerol and a fatty acid.

While such antifoam agents in granulate form appear to exhibit desirable stability upon storage, when incorporated in detergent compositions, it has been found that such antifoam granulates were not ideally suited for an easy incorporation into detergent compositions in powder form, such as dry-mixing.

It is thus the object of the present invention to provide storage-stable foam controlling agents, in the form of granulates which are free flowing and easily processable into a detergent composition.

SUMMARY OF THE INVENTION

The present invention provides a stable, free-flowing foam-control agent in granular form for inclusion in a detergent composition in powder form, comprising a silicone antifoam compound, a carrier material, preferably starch, an organic coating material, characterized in, that it contains a crystalline or amorphous aluminosilicate, at a weight ratio with the silicone antifoam compound of 1:5 to 2:1, preferably 1:3 to 1:1.

The present invention also provides a method for making such agents, as well as detergent compositions containing a surface-active agent, said foam control agent, and optionally other detergent ingredients.

DETAILED DESCRIPTION OF THE INVENTION

The Silicone Antifoam Compound

The silicone antifoam compound is present in the foam-control agents of the invention., at levels of from 5% to 20% by weight, preferably 8% to 15% by weight.

In industrial practice, the term "silicone" has become a generic term which encompasses a variety of relatively high-molecular-weight polymers containing siloxane units and hydrocarbyl groups of various types. Generally, the silicone suds-controllers can be described as siloxanes having the general structure:

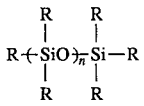

where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end-blocking units and having a viscosity at 25° C. of from $5\times10^{-5}m^2/s$ to $0.1m^2/s$ i.e. a value of n in the range 40 to 1500. These are preferred because of their ready availability and their relatively low cost.

A preferred type of silicone antifoam agent useful in the compositions herein comprises a mixture of an alkylated siloxane of the type hereinabove disclosed and solid silica.

The solid silica can be a fumed silica, a precipitated silica or a silica made by the gelformation technique. The silica particles suitably have an average particle size of from 0.1 to 50μ, preferably from 1 to 20μ and a surface area of at least $50m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. Silicone antifoams employed in a foam control agent according to the invention suitably have an amount of silica in the range of 1 to 30% (more preferably 2.0 to 15%) by weight of the total weight of the silicone antifoam resulting in silicone antifoams having an average viscosity in the range of from $2\times10^{-4}m^2/s$ to $1m^2/s$. Preferred silicone antifoams may have a viscosity in the range of from $5\times10^{-3}m^2/s$ to $0.1m^2/s$. Particularly suitable are silicone antifoams with a viscosity of $2\times10^{-2}m^2/s$ or $4.5\times10^{-2}m^2/s$.

The Carrier Material

The carrier material for use herein provides the solid basis on which the silicone antifoam agent and the organic coating material are deposited during manufacture; the carrier material must therefore be in the form of solid particles, which are compatible with detergent ingredients, are water-soluble or water-dispersible to facilitate the dispersion of the silicone antifoam agent in the aqueous liquor during the wash cycle, and are capable to absorb or adsorb the silicone antifoam agent.

The carrier material is present in the present foam control agents at levels of from 50% to 90% by weight, preferably 60% to 75% by weight.

A preferred carrier material for use in foam control agents according to the: invention is starch, native or chemically modified both hot or cold gelling in water; other suitable materials are kieselguhur and Fuller's earth.

It is also possible to choose carrier particles for use herein, among ingredients which themselves play an active role in the laundering or washing process. Examples of such materials are zeolites, sodium tripolyphosphate (STPP) particles, sodium sulphate, sodium citrate, sodium carbonate, carboxymethylcellulose and clay minerals.

The Organic Coating Material

The organic coating material is present at levels of from 5 to 30% of the antifoam agents according to the invention, preferably from 8% to 22% by weight.

Organic coating material suitable for use in the granules of the present invention, can be water soluble/dispersible species, water-insoluble species, or a mixture thereof.

Water-soluble or water-dispersible carrier materials must be impermeable to detergent and must be substantially non-surface active. By substantially non-surface active is meant that the carrier material, itself, does not interact with the silicone material in such fashion that it is emulsified or otherwise excessively dispersed throughout an aqueous medium, rather than at the air/water interface.

A wide variety of carrier materials having the requisite solubility/dispersibility characteristics and the essential features of being non-surface active and detergent-impermeable are known. For example, the high-molecular-weight Carbowaxes ("Carbowax" is a trade mark) which have substantially not surface-active characteristics are useful herein. Examples of this type of material include the polyethyleneglycols having a molecular weight of from about 1,500 to about 10,000, especially about 4,000. Highly ethoxylated fatty alcohols such as tallow alcohol condensed with about 25 molar proportions of ethylene oxide are useful herein. Other alcohol condensates containing extremely high ethoxylate proportions (ca. 80) are also useful herein.

Such high ethoxylates apparently lack sufficient surface-active characteristics to interact or otherwise interfere with the desired suds-control properties of the silicone agents herein. A particularly preferred ethoxylated carrier material herein is tallow alcohol condensed with about 80 molar proportions of ethylene oxide, and abbreviated $TAE_{80}$.

A variety of other materials useful as water-soluble/dispersible coating agents herein may also be mentioned: gelatin; agar; gum arabic; and various algae-derived gels.

Water-insoluble organic materials suitable for use in a foam control agent according to the invention are water-insoluble fatty acids, fatty alcohols, fatty acid esters and mixtures thereof. Fatty acids or fatty alcohols are species which have from 10 to 20 carbon in their alkyl chain.

Suitable fatty acids are saturated or unsaturated and can be obtained from natural sources such as, for example, plant or animal esters (e.g. palm oil, coconut oil, babassu oil, safflower oil, taloil, castor oil, tallow and fish oils, grase, and mixtures thereof) or can be synthetically prepared for example via the oxidation of petroleum or by hydrogenation of carbon monooxide via the Fisher-Tropsch process. Examples of suitable fatty acids for use in the present invention include capric, lauric, myristic, palmitic, stearic, arachidic and behenic acid.

Preferred is stearic acid. Also preferred is tallow ($C_{16}$–$C_{18}$) fatty acid. Alcohols derived from the above-mentioned fatty acids are suitable for the foam control agents herein, stearic alcohol and tallow ($C_{16}$–$C_{18}$) alcohol being preferred.

Esters of the above-mentioned fatty acids with $C_{1-3}$ alcohols are also suitable, such as ethyl myristate, ethyl stearate, methyl palmitate, and glycerol mono stearate, this latter species being especially preferred.

Among the above water-insoluble fatty materials, stearyl acid and stearyl alcohol are especially preferred. These materials are preferred because of their good performance, easy availability and suitable melting point. The melting points of stearic acid and stearyl alcohol are 71.5° and 59.4° C. respectively at which temperatures they are insoluble in water. These materials do not appear to interfere with the effectiveness of the silicone antifoam when it is released into the washing liquor.

Mixtures of the above water-soluble/dispersible coating agents and of the above water-insoluble organic materials herein are also suitable. A preferred mixture is stearyl alcohol and $TAE_{80}$.

The amount of organic coating material employed in the foam control agents herein should be no less than 1 part organic coating material per part of silicone antifoam. It is preferred to employ the organic coating material and the silicone antifoam in a weight ratio in the range 5:1 to 1:2, more preferably in the range 4:1 to 1:1.

The Crystalline or Amorphous Aluminosilicate

The aluminosilicate builder present in the compositions of the invention may be crystalline or amorphous or a mixture thereof, and has the general formula 0.8–1.5 $Na_2O$. $Al_2O_3$. 0.8–6 $SiO_2$.

These materials contain some bound water and are required to have a calcium ion exchange capacity of at least about 50 mg CaO/g. The preferred aluminosilicates contain 1.5–3.5 $SiO_2$units (in the formula above) and have a particle size of not more than about 100 microns, preferably not more than about 20 microns. Both amorphous and crystalline aluminosilicates can be made readily by reaction between sodium silicate and sodium aluminate, as amply described in the literature. crystalline aluminosilicates (zeolites) are preferred for use in the present invention. Suitable materials are described, for example,GB 1 429 143. The preferred sodium aluminosilicates of this type are the well-known commercially available zeolites A and X, and mixtures thereof. Especially preferred for use in the present invention is Type 4A zeolite.

The aluminosilicate is present in the foam-control agents herein, at a weigth ratio with the silicone antifoam compound of from 1:5 to 2:1, preferably 1:3 to 1:1. Typically the aluminosilicate is present at levels of from 3% to 15% of the foam-control agents herein.

Optional Ingredients

The foam control agents herein may advantageously comprise glycerol, in addition to the essential ingredients described hereinabove. Glycerol can be present at a weight ratio of 1:2 to 3:1 with the silicone antifoam agent, and at levels of from 2 to 20%, preferably 8% to 15% of the foam control agents herein. Other optional ingredients include waxes, and anti-caking agents.

Preferred waxes are of mineral origin, especially those derived from petroleum, including microcrystalline and oxidised microcrystalline petroleum waxes and paraffin waxes. However synthetic waxes, or natural waxes such as Montan waxes, beeswax, candelilla or carnauba waxes may also be used as may a mixture of any of these waxes. Whatever wax is used it is preferred that its melting point is between 35° and 70° C. so that it is readily liquifiable.

Suitable anti-caking agents include alkoxylated nonionic surfactants such as described hereinafter.

Making Process for the Anti-foam Agent of the Invention

The process herein consists basically of two steps, namely 1) the agglomeration of silicone antifoam compound, carrier material and organic coating material, followed by 2) the addition of aluminosilicate.

1) The agglomeration takes place in a standard agglomeration unit (Schugi type or Lödige CB/KM type blending machines) where compounds in both liquid and granular form are fed continuously (preferred option) or batchwise into the agglomerator.

The liquid compounds in form consist of the silicone antifoam compound, and the organic coating agent which can be added in two separate streams or mixed before addition.

The compound in granular form consists in the carrier material (e.g. starch).

2) The addition of aluminosilicate can be effected in two different ways (option a) and b) hereinbelow), but the best feature of the present process is that such an addition be made at temperatures ranging from 40° to 70° C., preferably in the range from 50° C. to 55° C.

Adding zeolite at temperatures outside this range will not yield free-flowing granules.

Option 1: The product leaving the agglomerator at a temperature in the range 45° C. to 55° C. is fed into a Lö dige KM ploughshare (low energy intensive) mixer where aluminosilicate is added at appropriate levels. The residence time in this mixer can be as low as 30 seconds but as high as 3 to 4 minutes. The product is than fed into the fluidized bed for cooling down to 25°–35° C.

Option 2 :The product leaving the agglomerator at a temperature in the range 45° C. to 55° C. is fed into a dual compartment fluidized bed with a heating and a cooling section. The product is kept at 45° to 55° C. in the first part of the "heated" fluidized bed, and aluminosilicate is being blown into this part at appropriate levels. This product is than fed into the second part of the fluidized bed for cooling down to 25°–35° C.

Detergent Compositions

In another embodiment of the present invention, it is herewith provided a detergent composition in powder form, comprising a surface-active agent and a foam control agent such as described above. The amount of foam control agents is from 0.25 to 10%, preferably from 0.5 to 3 by weight of the total detergent composition.

Suitable surface-active agents are of the anionic, cationic, non-ionic or amphoteric type, or mixtures thereof. Suitable anionic organic detergent surfactants include alkali metal soaps of higher fatty acids, alkyl aryl sulphonates, for example sodium dodecyl benzene sulphonate, long chain (fatty) alcohol sulphates, olefine sulphates and sulphonates, sulphated monoglycerides, sulphated ethers, sulphosuccinates, alkane sulphonates, phosphate esters, alkyl isothionates, sucrose esters and fluorosurfactants. Suitable cationic organic detergent surfactants include alkyl-amine salts, quaternary ammonium salts, sulphonium salts and phosphonium salts. Suitable non-ionic organic surfactants include condensates of ethylene oxide with a long chain (fatty) alcohol or fatty acid, for example $C_{14-15}$ alcohol, condensed with 7 moles of ethylene oxide (Dobanol$^R$ 45–7), condensates of ethylene oxide with an amine or an amide, condensation products of ethylene and propylene oxides, fatty acid alkylol amides and fatty amine oxides. Suitable amphoteric organic detergent surfactants include imidazoline compounds, alkylaminoacid salts and betaines.

The detergent compositions herein preferably also contain a builder, which is preferably a non-phosphate species; accordingly, the builder herein preferably is selected from aluminosilicate ion exchangers (zeolites), and water-soluble monomeric or oligomeric carboxylate chelating agents such as citrates, succinates, oxydisuccinates, as well as mixtures of the above species.

Other suitable builder materials include alkali metal carbonates, bicarbonates and silicates, organic phosphonates, amino polyalkylene phosphonates and amino polycarboxylates, ethylene diamine tetraacetic acid and nitrilotriacetic acid. Other suitable water-soluble organic salts are the homo- or co-polymeric polycarboxylic acids or their salts in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Other ingredients which typically form part of a detergent composition in powder form include bleaching agents, such as sodium perborate and percarbonate, bleach activators, anti redeposition agents such as carboxymethyl cellulase, enzymes, brighteners, fabric softening clays, perfumes, dyes, pigments.

Example I

A reference and a foam-control agent according to the invention (example I) are produced, the foam-control agent of example I being made according to the method described hereinabove (temperature of addition of zeolite around 50° C.):

| ingredients | Reference | Example I percent by weight |
|---|---|---|
| Silicone antifoam compound* | 12% | 10.9% |
| Zeolite 4A | — | 9.1% |
| Stearyl Alcohol | 18% | 16.3% |
| Starch | 70% | 63.7% |
| Density (g/liter) | 358 | 654 |
| % compression | 30.5 | 15.7 |
| Cake strength lb t/sq in | 10.3 | 3 |

*Polydimethyl siloxane/fumed silica X2/3419 from Dow Corning

The above results snow the effect of using zeolite, in order to obtain characteristics such as density, compress ion, and cake strength.

Such characteristics do reflect the fact that contrary to the reference agglomerates, the agglomerates of example I are free-flowing and non sticky, thus perfectly suited for dry-mixing into a detergent composition in powder form.

Example II

The following foam-control agents containing glycerol were also prepared:

| ingredients | Reference | Example II percent by weight |
|---|---|---|
| Silicone antifoam compond* | 12 | 12 |
| Zeolite 4A | — | 7 |
| Tallow fatty acid | 15 | 15 |
| Glycerol | 6 | 6 |
| Starch | 67 | 60 |
| Density (g/liter) | 420 | 624 |
| % compression | 27.4 | 13.0 |
| Cake strenght lb t/sq in | 8.6 | 1.7 |

*Polydimethyl siloxane/fumed silica X2/3419 from Dow Corning

The above results also show that the agglomerates of Example II are free-flowing and non-sticky, thus perfectly suited for dry mixing into a detergent composition in powder form.

Typical detergent compositions in powder form in which the present antifoam agents in granular form are included have the following formulae:

| Ingredients | (all levels in % by weight) Ex. III | Ex. IV |
|---|---|---|
| LAS | 8.00 | 6.50 |
| TAS | 2.50 | 3.35 |
| FA45E7 | 5.00 | 2.00 |
| Na citrate/citric acid | — | 12.00 |
| Zeolite 4A | 24.00 | 16.00 |
| Copolymer AA/MA | 5.00 | 3.50 |
| Phosphonate | 0.60 | — |
| EDTA | 0.25 | 0.30 |
| Na carbonate | 17.00 | 10.00 |
| Silicate (R = 2) | 2.00 | 2.50 |
| CMC | 0.50 | — |
| Clay | — | 8.50 |
| PB1 | 13.00 | — |
| PB4 | — | 12.00 |
| TAED | 5.70 | 3.20 |
| Enzyme | 1.70 | 1.70 |
| Foam control agent | 0.70 | 0.80 |
| Minors + water | balance to 100% | |

The abbreviations for the individual ingredients have the following meaning:

LAS: sodium salt of linear dodecyl benzene sulfonate

TAS: sodium salt of tallow alcohol sulfate

FA45E7 : fatty alcohol ($C_{14}$–$C_{15}$) ethoxylated with about 7 moles of ethylene oxide Clay: smectite clay Zeolite 4A: sodium salt of zeolite 4A with average particle size between 1–10 micrometer Copolymer AA/MA: copolymer of acrylic acid and maleic acid CMC: carboxymethylcellulose Phosphonate: sodium salt of ethylenediamine tetramethylene phosphonic acid EDTA : sodium salt of ethylenediamine tetra acetate PB1: NaBO2.H202 (Sodium Perborate Monohydrate)

PB4: NaBO2.H202.3H20 (Sodium Perborate Tetrahydrate)

TAED: tetra acetyl ethylene diamine

We claim:

1. A stable, free-flowing foam control agent granule, comprising 5 to 20% of a silicone antifoam compound wherein said silicone antifoam compound comprises a polydiorganosilaxane and solid silicia, from 40 to 80% of a carrier material, from 5 to 30% of an organic coating material, and from 3 to 15% by weight of a crystalline or amorphous aluminosilicate at a weight ratio with the silicone compound of 1/3 to 1/1.

2. A foam-control agent according to claim 1 wherein the carrier material is starch.

3. A foam-control agent according to claim 1 wherein the organic coating agent is selected from water-soluble or water-dispersible, substantially non-surface active, detergent impermeable materials, from water-insoluble fatty acids, and/or fatty alcohols and/or fatty acid esters, and from mixtures thereof.

4. A foam-control agent according to claim 3 wherein the water-soluble/dispersible, organic coating agent is selected from highly ethoxylated fatty alcohols, condensed with about 25 molar to 80 molar proportions of ethylene oxide.

5. A foam-control agent according to claim 3 wherein the water-insoluble fatty acid and/or fatty alcohols have a carbon chain length of from 12 to 20 carbon atoms and a melting point in the range of from 45° C. to 80° C.

6. A foam-control agent according to claim 3 wherein the organic coating agent is selected from stearic acid, stearyl alcohol, tallow fatty acid, tallow fatty alcohol, tallow alcohol condensed with about 80 molar proportions of ethylene oxide, and mixtures thereof.

7. A foam-control agent according to claim 3 wherein the crystalline or amorphous silicate of the foam control agent consists of from 3 to 5% zeolite.

8. A process for making a foam-control agent according to claim 1, wherein the silicone antifoam compound, the carrier material and the organic coating material are agglomerated together, and then aluminosilicate is added to the agglomerates, at a temperature in the range from 40° to 70° C.

9. A process according to claim 8 wherein said temperature is in the range from 45° C. to 55° C.

10. A detergent composition in powder form comprising a surface-active agent, and a foam-control agent according to any of claim 1.

11. A stable, free-flowing foam-control agent granule, comprising 5% to 20% of a silicone antifoam compound wherein said silicone antifoam compound comprises a polydiorganosiloxane and solid silicia, from 40% to 80% of a carrier material, from 5% to 30% of an organic coating material, from 2% to 20% of a glycerol, and from 3% to 15% by weight of a crystalline or amorphous aluminosilicate at a weight ratio with the silicone antifoam compound of 1/3 to 1/1.

* * * * *

UNITED STATES PATENT AND TRADEMARK OFFICE

CERTIFICATE OF CORRECTION

PATENT NO. : 5,540,856

DATED : July 30, 1996

INVENTOR(S) : Wevers, et. al.

It is certified that error appears in the above-indentified patent and that said Letters Patent is hereby corrected as shown below:

In Column 8, line 1, change "silicia" to -- silica --.

In Column 8, line 4, insert "antifoam" after "silicone".

In Column 8, line 14, change "3" to -- 1 --.

In Column 8, line 18, change "3" to -- 1 --.

In Column 8, line 31, change "1" to -- 5 --.

In Column 8, line 35, change "8" to -- 5 --.

Signed and Sealed this

Twenty-sixth Day of August, 1997

*Attest:*

Bruce Lehman

BRUCE LEHMAN

*Attesting Officer*

*Commissioner of Patents and Trademarks*